US011519630B2

(12) United States Patent
Yin et al.

(10) Patent No.: US 11,519,630 B2
(45) Date of Patent: Dec. 6, 2022

(54) METHOD AND DEVICE FOR ADJUSTING AIR VOLUME OF AIR CONDITIONER, AND COMPUTER READABLE STORAGE MEDIUM

(71) Applicants: Qingdao Haier Air-Conditioning Electronic Co., Ltd, Qingdao (CN); HAIER SMART HOME CO., LTD., Qingdao (CN)

(72) Inventors: Pengfei Yin, Qingdao (CN); Dahai Lu, Qingdao (CN); Haisheng Wang, Qingdao (CN); Zhongxiao Zhang, Qingdao (CN); Wei Zhang, Qingdao (CN); Yanfang Cai, Qingdao (CN); Ningning Duo, Qingdao (CN); Lirong Zhu, Qingdao (CN)

(73) Assignees: QINGDAO HAIER AIR-CONDITIONING ELECTRONIC CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 197 days.

(21) Appl. No.: 15/733,571

(22) PCT Filed: Oct. 23, 2018

(86) PCT No.: PCT/CN2018/111356
§ 371 (c)(1),
(2) Date: Aug. 28, 2020

(87) PCT Pub. No.: WO2019/184316
PCT Pub. Date: Oct. 3, 2019

(65) Prior Publication Data

US 2020/0408432 A1 Dec. 31, 2020

(30) Foreign Application Priority Data

Mar. 30, 2018 (CN) ..... 201810296272.9

(51) Int. Cl.
*F24F 11/74* (2018.01)
*F24F 11/64* (2018.01)
*F24F 13/20* (2006.01)

(52) U.S. Cl.
CPC ..... *F24F 11/74* (2018.01); *F24F 11/64* (2018.01); *F24F 13/20* (2013.01)

(58) Field of Classification Search
CPC .. F24F 11/30; F24F 11/70; F24F 11/74; F24F 11/755; F24F 13/06–065; F24F 13/20
See application file for complete search history.

(56) References Cited

U.S. PATENT DOCUMENTS 4,305,418 A * 12/1981 Jensen ..... F16K 1/126 137/219
5,547,721 A 8/1996 Kuo
2012/0238199 A1* 9/2012 Kim ..... F24F 13/062 454/237

FOREIGN PATENT DOCUMENTS

CN 2554530 Y 6/2003
CN 1453535 A 11/2003
(Continued)

OTHER PUBLICATIONS

Office action from Chinese Application No. 201810997068.X dated Feb. 2, 2021.
(Continued)

*Primary Examiner* — Edelmira Bosques
*Assistant Examiner* — Michael James Giordano
(74) *Attorney, Agent, or Firm* — Calfee, Halter & Griswold LLP

(57) ABSTRACT

A method and device are for adjusting air volume of an air conditioner are provided, that use a computer readable storage medium. The air conditioner includes an indoor unit with a vase-shaped housing, wherein the vase-shaped housing includes a bottle mouth and where an air outlet of the
(Continued)

indoor unit is provided at the bottle mouth of the vase-shaped housing. A liftable cover plate is provided at the air outlet of the indoor unit. The method includes obtaining specified air volume, obtaining curved surface features of an inner wall at the bottle mouth of the vase-shaped housing and cover plate specifications of the cover plate, and adjusting an actual height of the cover plate according to the specified air volume, the curved surface features, and the cover plate specifications.

3 Claims, 4 Drawing Sheets

(56) References Cited

FOREIGN PATENT DOCUMENTS

| | | | | |
|---|---|---|---|---|
| CN | 2864455 | Y | | 1/2007 |
| CN | 202048737 | U | | 11/2011 |
| CN | 203442968 | U | | 2/2014 |
| CN | 104154634 | A | | 11/2014 |
| CN | 204786761 | U | | 11/2015 |
| CN | 105526635 | A | * | 4/2016 |
| CN | 107702210 | A | | 2/2018 |
| CN | 207486962 | U | | 6/2018 |
| CN | 108444122 | A | | 8/2018 |
| CN | 108548276 | A | | 9/2018 |
| JP | 2015052414 | A | * | 3/2015 |
| KR | 100490595 | B1 | | 5/2005 |
| KR | 100775070 | B1 | | 11/2007 |

OTHER PUBLICATIONS

International Search Report from International Application No. PCT/CN2018/111356 dated Jan. 15, 2019.
Office Action from Chinese Application No. 201810296272.9 dated Nov. 15, 2019.
Office action from Chinese Application No. 201810997068.X dated May 13, 2021.
Written Opinion from PCT/CN2018/115670 dated May 16, 2019.

* cited by examiner

METHOD AND DEVICE FOR ADJUSTING AIR VOLUME OF AIR CONDITIONER, AND COMPUTER READABLE STORAGE MEDIUM

CROSS-REFERENCE TO RELATED APPLICATIONS

The application is a U.S. National Phase of PCT/CN2018/111356, filed Oct. 23, 2018, which is based upon and claims priority to Chinese Patent Application No. 201810296272.9, filed Mar. 30, 2018, the entire contents of which are incorporated herein by reference.

TECHNICAL FIELD

The present disclosure relates to the field of air conditioner technologies, and more particularly, to a method and device for adjusting air volume of an air conditioner and a computer readable storage medium.

BACKGROUND

In the prior art, a method for controlling air volume of an indoor unit of a conventional air conditioner has matured. In interior decoration, with increasing demand for aesthetics, a new indoor unit of the air conditioner combining a vase for interior decoration with the indoor unit of the air conditioner has gradually appeared.

Since the structure of the new indoor unit of the air conditioner is quite different from that of the indoor unit of the conventional air conditioner, the method for adjusting the air volume of the indoor unit of the conventional air conditioner is not suitable for the new indoor unit of the air conditioner.

SUMMARY

Embodiments of the present disclosure provides a method for adjusting air volume of an air conditioner, which solves the problem of adjusting air volume of a new indoor unit of the air conditioner.

In order to have a basic understanding of some aspects of the disclosed embodiments, a brief summary is given below. This summary is not a general comment, nor is it intended to identify key/important constituent elements or describe the scope of protection of these embodiments. The sole purpose thereof is to present some concepts in a simplified form as a preface to the following detailed description.

According to a first aspect of the embodiments of the present disclosure, there is provided a method for adjusting air volume of an air conditioner.

In some optional embodiments, the air conditioner includes an indoor unit with a vase-shaped housing, wherein the vase-shaped housing includes a bottle mouth, an air outlet of the indoor unit is provided at the bottle mouth of the vase-shaped housing, and a liftable cover plate is provided at the air outlet of the indoor unit, the method includes:

obtaining specified air volume;

obtaining curved surface features of an inner wall at the bottle mouth of the vase-shaped housing and cover plate specifications of the cover plate; and adjusting an actual height of the cover plate according to the specified air volume, the curved surface features and the cover plate specifications.

In some optional embodiments, the adjusting the actual height of the cover plate according to the specified air volume, the curved surface features and the cover plate specifications includes:

obtaining a corresponding relationship between actual air volume and the actual height of the cover plate according to the curved surface features and the cover plate specifications; and adjusting the actual height of the cover plate according to the specified air volume and the corresponding relationship.

In some optional embodiments, the obtaining the corresponding relationship between the actual air volume and the actual height of the cover plate according to the curved surface features and the cover plate specifications includes:

obtaining an actual opening of the air outlet according to the actual air volume;

obtaining a first actual horizontal distance between an edge of the cover plate and the inner wall at the bottle mouth of the vase-shaped housing according to the actual opening of the air outlet and the curved surface features;

obtaining the actual height of the cover plate according to the first actual horizontal distance and the curved surface features; and obtaining the corresponding relationship between the actual air volume and the actual height of the cover plate.

In some optional embodiments, the obtaining the corresponding relationship between the actual air volume and the actual height of the cover plate according to the curved surface features and the cover plate specifications includes:

obtaining a second actual horizontal distance between an edge of the cover plate and the inner wall at the bottle mouth of the vase-shaped housing;

changing the actual height of the cover plate;

obtaining a first change height of the actual height of the cover plate;

obtaining a first change distance of the second actual horizontal distance;

obtaining a first ratio of the first change height to the first change distance;

obtaining a relative unit change height of the cover plate corresponding to unit change air volume according to the first ratio, wherein an absolute value of the first ratio is positively correlated with the relative unit change height of the cover plate; and accumulating relative unit change heights of a plurality of cover plates to obtain the actual height of the cover plate.

According to a second aspect of the embodiments of the present disclosure, there is provided a computer readable storage medium.

In some optional embodiments, the computer readable storage medium has a computer program stored thereon, when the computer program is executed by a processor, the aforementioned method is implemented.

According to a third aspect of the embodiments of the present disclosure, there is provided a device for adjusting air volume of an air conditioner.

In some optional embodiments, the air conditioner includes an indoor unit with a vase-shaped housing, wherein the vase-shaped housing includes a bottle mouth, an air outlet of the indoor unit is provided at the bottle mouth of the vase-shaped housing, and a liftable cover plate is provided at the air outlet of the indoor unit, the device includes:

a first obtaining module configured to obtain specified air volume;

a second obtaining module configured to obtain curved surface features of an inner wall at the bottle mouth of the vase-shaped housing and cover plate specifications of the cover plate;

and an execution module configured to adjust an actual height of the cover plate according to the specified air volume, the curved surface features and the cover plate specifications.

In some optional embodiments, the execution module includes:

a configuration unit configured to obtain a corresponding relationship between actual air volume and the actual height of the cover plate according to the curved surface features and the cover plate specifications; and an execution unit configured to adjust the actual height of the cover plate according to the specified air volume and the corresponding relationship.

In some optional embodiments, the configuration unit is further configured to:

obtain an actual opening of the air outlet according to the actual air volume;

obtain a first actual horizontal distance between an edge of the cover plate and the inner wall at the bottle mouth of the vase-shaped housing according to the actual opening of the air outlet and the curved surface features;

obtain the actual height of the cover plate according to the first actual horizontal distance and the curved surface features; and obtain the corresponding relationship between the actual air volume and the actual height of the cover plate.

In some optional embodiments, the configuration unit is further configured to:

obtain a second actual horizontal distance between an edge of the cover plate and the inner wall at the bottle mouth of the vase-shaped housing;

change the actual height of the cover plate;

obtain a first change height of the actual height of the cover plate;

obtain a first change distance of the second actual horizontal distance;

obtain a first ratio of the first change height to the first change distance;

obtain a relative unit change height of the cover plate corresponding to unit change air volume according to the first ratio, wherein an absolute value of the first ratio is positively correlated with the relative unit change height of the cover plate; and accumulate relative unit change heights of a plurality of cover plates to obtain the actual height of the cover plate.

According to a fourth aspect of the present disclosure, there is provided a device for adjusting air volume of an air conditioner.

In some optional embodiments, the device is applied to an indoor unit of the air conditioner including an indoor unit with a vase-shaped housing, wherein the vase-shaped housing includes a bottle mouth, an air outlet of the indoor unit is provided at the bottle mouth of the vase-shaped housing, and a liftable cover plate is provided at the air outlet of the indoor unit, the device includes:

a processor; and a memory for storing instructions executable by the processor;

wherein the processor is configured to:

obtain specified air volume;

obtain curved surface features of an inner wall at the bottle mouth of the vase-shaped housing and cover plate specifications of the cover plate; and adjust an actual height of the cover plate according to the specified air volume, the curved surface features and the cover plate specifications.

According to the embodiments of the present disclosure, by combining structural features of the new indoor unit of the air conditioner, the actual air volume can reach the specified air volume. When the vase-shaped housing is placed vertically, the higher the position of the cover plate, the larger the gap between the cover plate and the bottle mouth; and the larger the actual opening of the air outlet, the greater the air volume. Therefore, the actual air volume can be adjusted to the specified air volume by adjusting the actual height of the cover plate.

It should be understood that both the foregoing general description and the following detailed description are exemplary and explanatory only and are not intended to limit the present disclosure.

BRIEF DESCRIPTION OF THE DRAWINGS

The accompanying drawings, which are incorporated in and constitute a part of this description, illustrate embodiments consistent with the present disclosure and, together with the description, serve to explain the principles of the present disclosure.

DETAILED DESCRIPTION

Figure 1:
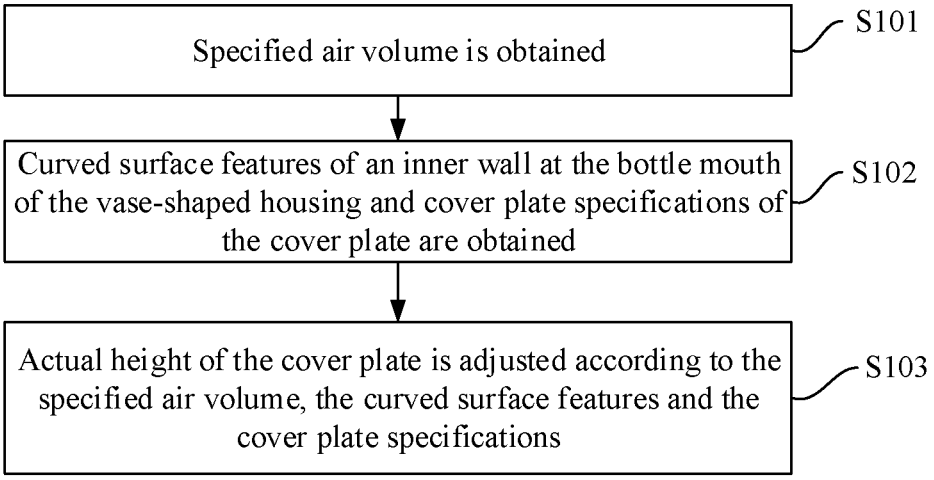
FIG. 1 is a schematic flowchart illustrating a method for adjusting air volume of an air conditioner according to an exemplary embodiment.

The following description and accompanying drawings fully illustrate the specific implementation solutions of the present disclosure so that a person skilled in the art can practice them. The embodiments merely represent possible changes. Unless otherwise specified explicitly, the individual component and function are optional and the operation sequence may be changed. Parts and characteristics of some implementation solutions may be included in or replace parts and characteristics of other implementation solutions. The scope of the implementation solutions of the present disclosure includes the whole scope of the claims and all available equivalents of the claims. As used herein, each implementation solution may be independently or generally expressed by "present disclosure", which is merely for convenience. As a matter of fact, if more than one disclosure is disclosed, it does not mean that the scope of the application is automatically limited to any single disclosure or disclosure concept. As used herein, terms such as "first" and "second" are merely for distinguishing one entity or operation from another entity or operation and do not require or imply any actual relationship or sequence among these entities or operations. Moreover, terms such as "comprise" and "include" or any other variants indicate a non-exclusive inclusion, so that a process, method or device including a series of elements not only include these elements, but also include other elements not explicitly listed. Without further restrictions, the element defined by the statement "includes a/an . . . " does not exclude the existence of other identical elements in the process, method or device that includes the element. As used herein, each embodiment is described progressively, and contents focally described in each embodiment are different from those in other embodiments. The same or similar parts among each of the embodiments may be referred to each other. Regarding a structure, a product and the like disclosed in the embodiments, since they are corresponding to parts disclosed in the embodiments, their description is relatively simple and relevant contents can be referred to the description in the method part.

In the present disclosure, an air conditioner includes an indoor unit with a vase-shaped housing, wherein the vase-shaped housing includes a bottle mouth, an air outlet of the indoor unit is provided at the bottle mouth of the vase-shaped housing, and a liftable cover plate is provided at the air outlet of the indoor unit. The indoor unit of the air conditioner is the "new indoor unit of the air conditioner" in the present disclosure.

Specifically, the indoor unit of the air conditioner includes:

the vase-shaped housing;

the cover plate provided at the air outlet of the vase-shaped housing, wherein the air outlet is provided at the bottle mouth of the vase-shaped housing;

a transmission mechanism, one end of which is connected to the cover plate; and an actuator connected to the other end of the transmission mechanism, wherein a power source of the actuator is a motor;

the transmission mechanism includes: a lifting rod, one end of which is connected to the cover plate; and a gear provided on an armature shaft of the motor and movably connected to the other end of the lifting rod in a tooth meshing manner.

As shown in FIG. 1, according to a first aspect of the present disclosure, there is provided a method for adjusting air volume of an air conditioner.

In some optional embodiments, the method for adjusting air volume of the air conditioner includes:

S101, specified air volume is obtained;

S102, curved surface features of an inner wall at the bottle mouth of the vase-shaped housing and cover plate specifications of the cover plate are obtained; and S103, an actual height of the cover plate is adjusted according to the specified air volume, the curved surface features and the cover plate specifications.

The present embodiment combines structural features of the new indoor unit of the air conditioner, so that the actual air volume reaches the specified air volume.

In general, a bottle mouth of a vase is trumpet-shaped, concave outward and convex inward. A longitudinal section is taken along a central axis of the bottle mouth to obtain two axisymmetric characteristic curves. The curved surface features in the present embodiment include but are not limited to a distance between the two characteristic curves and the shape of each characteristic curve. When the vase-shaped housing is placed vertically, the higher the position of the cover plate, the larger the gap between the cover plate and the bottle mouth; and the larger the actual opening of the air outlet, the greater the air volume. Therefore, the actual air volume can be adjusted to the specified air volume by adjusting the actual height of the cover plate. The cover plate specifications in step S103 refer to a shape, an area, a thickness, and the like of the cover plate. For example, when the cover plate is circular, the cover plate specifications include a radius, the cover plate, the thickness, and the like.

In some optional embodiments, step S102 may be implemented as:

the curved surface features of the inner wall at the bottle mouth of the vase-shaped housing and the cover plate specifications of the cover plate are directly read.

The inner wall at the bottle mouth of the vase-shaped housing is processed according to one or more characteristic curves, and the one or more characteristic curves are stored; or, after the vase-shaped housing is manufactured, a curvature of the inner wall at the bottle mouth has been measured by a technician, and the technician has stored the measured data; that is, the curved surface features and the cover plate specifications can be preset.

In some optional embodiments, step S103 may be implemented as:

actual air volume is obtained;

if the actual air volume is less than the specified air volume, the actual height of the cover plate is increased; and if the actual air volume is greater than the specified air volume, the actual height of the cover plate is reduced.

In the process of changing the actual height of the cover plate, if the actual opening of the air outlet between the cover plate and the inner wall changes slowly, the amount of change in the actual height of the cover plate is increased; and if the actual opening of the air outlet between the cover plate and the inner wall changes rapidly, the amount of change in the actual height of the cover plate is decreased, that is, the increase and decrease amount of the actual height of the cover plate are specified values obtained according to the curved surface features and the cover plate specifications.

Figure 2:
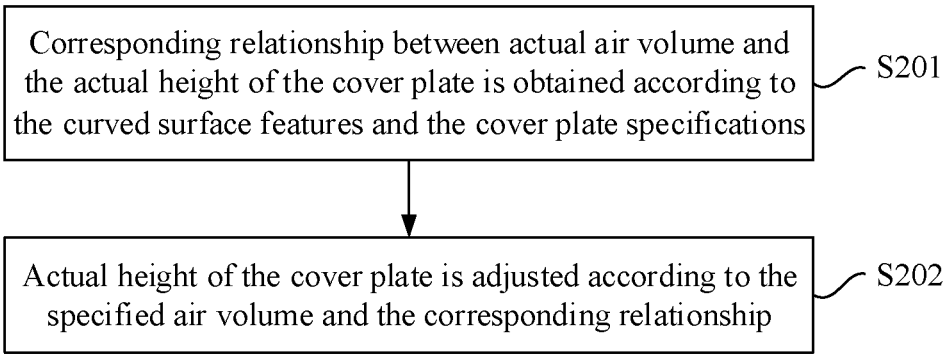
FIG. 2 is a schematic flowchart illustrating a method for adjusting air volume of an air conditioner according to an exemplary embodiment.

As shown in FIG. 2, in some optional embodiments, the adjusting the actual height of the cover plate according to the specified air volume, the curved surface features and the cover plate specifications includes:

S201, a corresponding relationship between actual air volume and the actual height of the cover plate is obtained according to the curved surface features and the cover plate specifications; and S202, the actual height of the cover plate is adjusted according to the specified air volume and the corresponding relationship.

In the present embodiment, the actual height of the cover plate can be purposefully adjusted to adjust the actual air volume to the specified air volume, and thus the adjustment process is more accurate. After the corresponding relationship between the actual air volume and the actual height of the cover plate is obtained, each air volume corresponds to a height of the cover plate. After the specified air volume is obtained, the height of the cover plate corresponding to the specified air volume is found in the corresponding relationship, and the actual height of the cover plate is adjusted to the height of the cover plate, that is, it is realized that the actual air volume is adjusted to the specified air volume.

In step S201, optionally, corresponding relationships between the curved surface features, the cover plate specifications and actual air volume and the actual height of the cover plate are stored in a database in advance. When step S201 is performed, it is searched in the database according to the curved surface features and the cover plate specifications to obtain the associated corresponding relationships.

Optionally, the indoor unit only performs step S201 once in the initialization stage, and stores the corresponding relationships after the corresponding relationships are obtained. When the indoor unit operates normally, the corresponding relationship is a known quantity, and the indoor unit skips step S201 and directly performs step S202.

Figure 3:
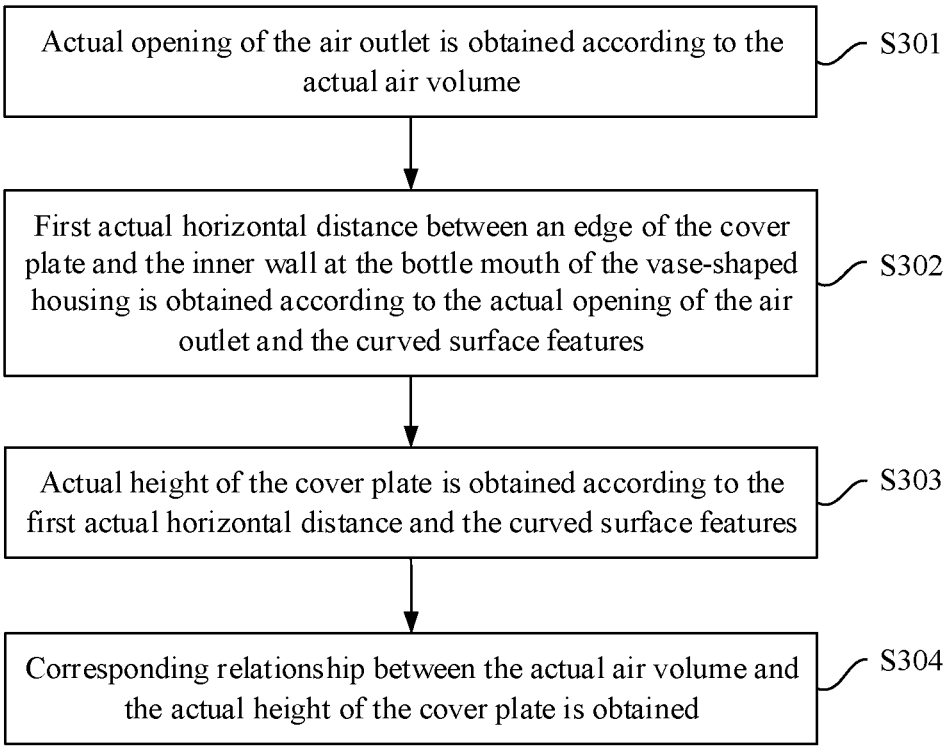
FIG. 3 is a schematic flowchart illustrating a method for adjusting air volume of an air conditioner according to an exemplary embodiment.

As shown in FIG. 3, in some optional embodiments, the obtaining the corresponding relationship between the actual air volume and the actual height of the cover plate according to the curved surface features and the cover plate specifications includes:

S301, an actual opening of the air outlet is obtained according to the actual air volume.

In this step, the greater the air volume, the larger the actual opening of the air outlet; and the smaller the air volume, the smaller the actual opening of the air outlet.

S302, a first actual horizontal distance between an edge of the cover plate and the inner wall at the bottle mouth of the vase-shaped housing is obtained according to the actual opening of the air outlet and the curved surface features.

In this step, the first actual horizontal distance is obtained by combining the curved surface features and the cover plate specifications. For example, the actual opening of the air outlet is an area of a cross section of the air outlet, which is surrounded by the edge of the cover plate and a circular edge on the inner wall. Optionally, when the circular edge on the inner wall and the cover plate are in the same horizontal plane, the cross section is annular, and an inner ring diameter thereof is known. A difference between an inner ring radius and an outer ring radius of a ring is the first actual horizontal distance.

S303, the actual height of the cover plate is obtained according to the first actual horizontal distance and the curved surface features.

S304, the corresponding relationship between the actual air volume and the actual height of the cover plate is obtained.

After the actual height of the cover plate is obtained in step S303, the corresponding relationship between the actual air volume and the actual height of the cover plate can be further obtained.

In the present embodiment, the actual height of the cover plate can be further adjusted accurately, so that the actual air volume can reach the specified air volume. The actual air volume has a relatively stable relationship with the actual opening of the air outlet, the actual opening of the air outlet has a stable relationship with the first actual horizontal distance, and the first actual horizontal distance has a stable relationship with the actual height of the cover plate, therefore, a relatively stable corresponding relationship between the actual air volume and the actual height of the cover plate can be obtained.

In some optional embodiments, the obtaining the actual height of the cover plate according to the first actual horizontal distance and the curved surface features includes:

the actual height of the cover plate is obtained according to the following formula:

$$H=aL^2+(2ax_0+b)\cdot L$$

where H is the actual height of the cover plate, L is the first actual horizontal distance, a and b are constants representing the curved surface features, and $x_0$ is an abscissa of the edge of the cover plate during sealing after a rectangular coordinate system is established on a longitudinal section taken along a central axis of the bottle mouth.

The technical solution further optimizes the solution of adjusting the actual height of the cover plate.

Figure 4:
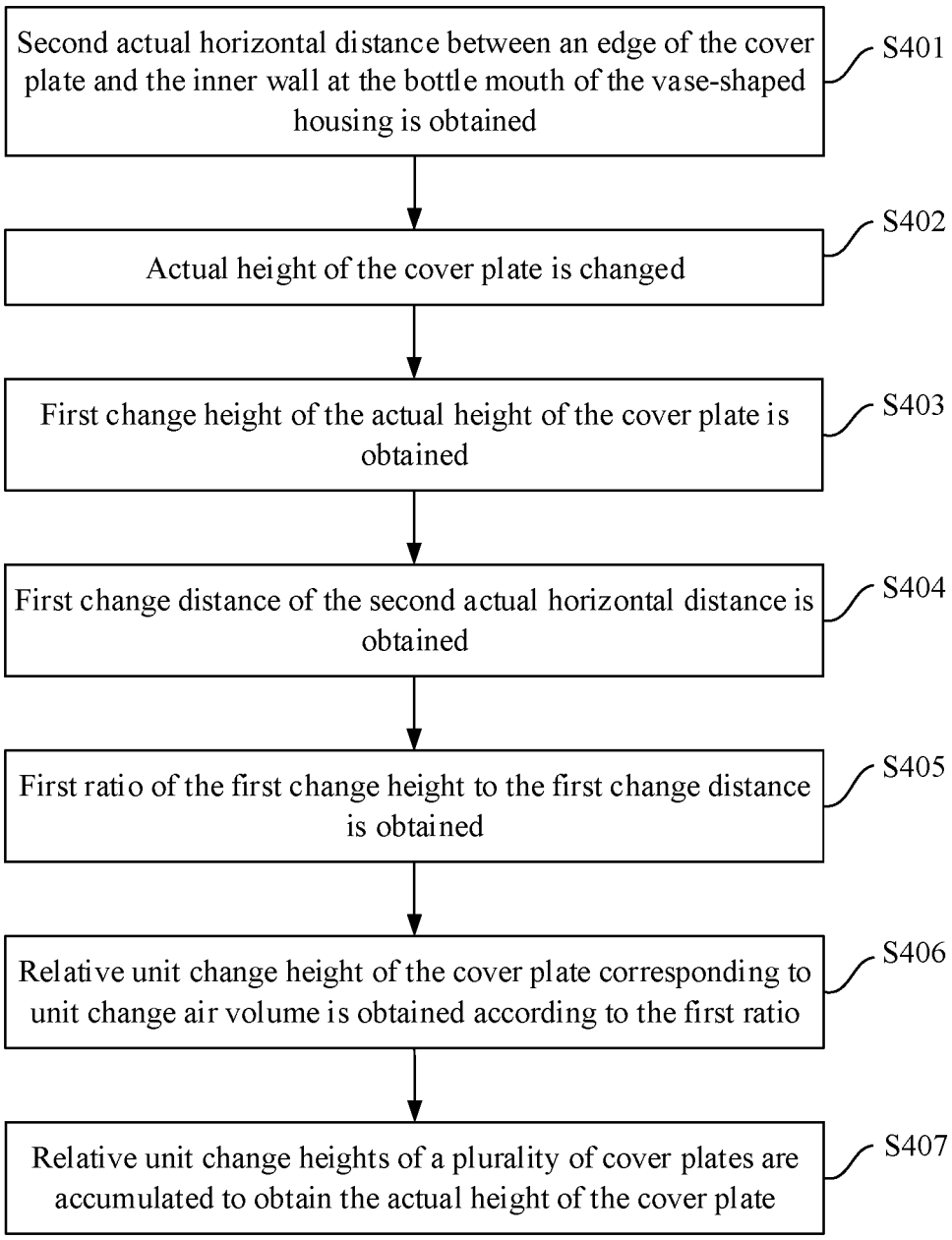
FIG. 4 is a schematic flowchart illustrating a method for adjusting air volume of an air conditioner according to an exemplary embodiment.

As shown in FIG. 4, in some optional embodiments, the obtaining the corresponding relationship between the actual air volume and the actual height of the cover plate according to the curved surface features and the cover plate specifications includes:

S401, a second actual horizontal distance between an edge of the cover plate and the inner wall at the bottle mouth of the vase-shaped housing is obtained;

S402, the actual height of the cover plate is changed;

S403, a first change height of the actual height of the cover plate is obtained;

S404, a first change distance of the second actual horizontal distance is obtained;

S405, a first ratio of the first change height to the first change distance is obtained;

S406, a relative unit change height of the cover plate corresponding to unit change air volume is obtained according to the first ratio, wherein an absolute value of the first ratio is positively correlated with the relative unit change height of the cover plate; and

S407, relative unit change heights of a plurality of cover plates are accumulated to obtain the actual height of the cover plate.

The unit change air volume is standard volume used for comparison when measuring the actual air volume of the indoor unit of the air conditioner. The relative unit change height refers to the actual height of the cover plate changes relative to the relative unit change height when the air volume changes per unit change. The unit change air volume is a fixed value, the relative unit change height is a variable value, and the relative unit change height changes with the first ratio.

In the present embodiment, the obtained actual height of the cover plate is more in line with the law of curved surface characteristics, and thus the air volume can be accurately adjusted.

The absolute value of the first ratio can represent the change of the relative unit change height when the unit change air volume changes. In some optional embodiments, the absolute value of the first ratio is positively correlated with the relative unit change height of the cover plate specifically includes:

the greater the absolute value of the first ratio, the greater the relative unit change height; and the smaller the absolute value of the first ratio is, the smaller the relative unit change height.

In some optional embodiments, the obtaining the relative unit change height of the cover plate corresponding to unit change air volume according to the first ratio includes:

multiplying a correction coefficient based on the first ratio to obtain a correction ratio; and obtaining the relative unit change height of the cover plate corresponding to the unit change air volume according to the correction ratio.

The actual air volume can be accurately adjusted according to the actual height of the cover plate obtained by the solution of the present disclosure.

The correction coefficient is related to the curved surface features, that is, different curved surface features have different correction coefficients.

Optionally, the smaller the bending degree of the characteristic curves of the curved surface features, the smaller the correction coefficient.

Optionally, the greater the bending degree of the characteristic curves of the curved surface features, the greater the correction coefficient.

In the case that the first change height and the first change distance are sufficiently small, the first ratio indicates the curved surface features where the inner wall and the cover plate are flush, and the correction ratio indicates the curved surface features of a projection of the edge of the cover plate on the inner wall. When a distance between the edge of the cover plate and the projection of the edge of the cover plate on the inner wall is the smallest, the actual air volume can best reflected.

Optionally, a value of the correction coefficient is 0 to 1.

In some optional embodiments, the specified air volume is greater than or equal to a lower limit of the air volume, and the specified air volume is less than or equal to an upper limit of the air volume.

The present embodiment can ensure that the air volume of the indoor unit of the air conditioner is maintained at a normal level, thereby avoiding a whistle and accelerating the change of indoor temperature. The lower limit of the air volume in the present embodiment means that when the specified air volume is at the lower limit of the air volume, the actual height of the cover plate is at the lowest height, and the whistle will appear at the air outlet at this time. The upper limit of the air volume in the present embodiment means that when the specified air volume is at the upper limit of the air volume, the actual height of the cover plate is at the highest height, at this time, the wind speed through the air outlet is low, and the cold or hot air of the indoor unit cannot be effectively blown to various places in a room, and thus the air in the room cannot quickly cannot exchange heat quickly, and the indoor temperature changes slowly.

According to a second aspect of the embodiments of the present disclosure, there is provided a computer readable storage medium.

In some optional embodiments, the computer readable storage medium has a computer program stored thereon, when the computer program is executed by a processor, the aforementioned method is implemented.

Figure 5:
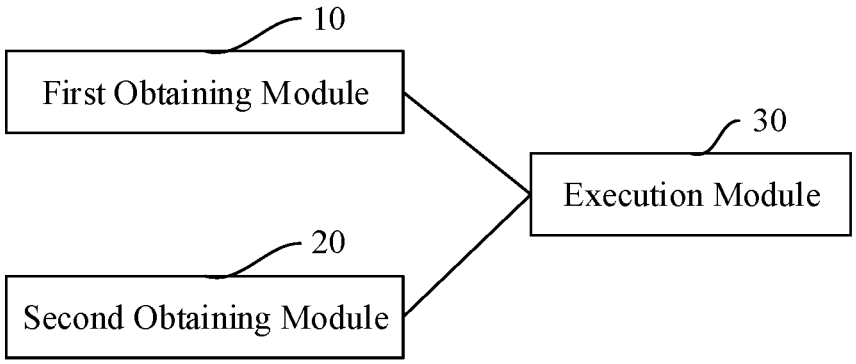
FIG. 5 is a structural block diagram illustrating a device for adjusting air volume of an air conditioner according to an exemplary embodiment.

As shown in FIG. 5, according to a third aspect of the embodiments of the present disclosure, there is provided a device for adjusting air volume of an air conditioner.

In some optional embodiments, the air conditioner includes an indoor unit with a vase-shaped housing, wherein the vase-shaped housing includes a bottle mouth, an air outlet of the indoor unit is provided at the bottle mouth of the vase-shaped housing, and a liftable cover plate is provided at the air outlet of the indoor unit, the device includes:

a first obtaining module 10 configured to obtain specified air volume;

a second obtaining module 20 configured to obtain curved surface features of an inner wall at the bottle mouth of the vase-shaped housing and cover plate specifications of the cover plate;

and an execution module 30 configured to adjust an actual height of the cover plate according to the specified air volume, the curved surface features and the cover plate specifications.

In some optional embodiments, the second obtaining module is further configured to directly read the curved surface features of the inner wall at the bottle mouth of the vase-shaped housing and the cover plate specifications of the cover plate.

In some optional embodiments, the execution module is further configured to obtain actual air volume;

if the actual air volume is less than the specified air volume, increase the actual height of the cover plate; and if the actual air volume is greater than the specified air volume, reduce the actual height of the cover plate.

In the process of changing the actual height of the cover plate, if the actual opening of the air outlet between the cover plate and the inner wall changes slowly, the amount of change in the actual height of the cover plate is increased; and if the actual opening of the air outlet between the cover plate and the inner wall changes rapidly, the amount of change in the actual height of the cover plate is decreased, that is, the increase and decrease amount of the actual height of the cover plate are specified values obtained according to the curved surface features and the cover plate specifications.

Figure 6:
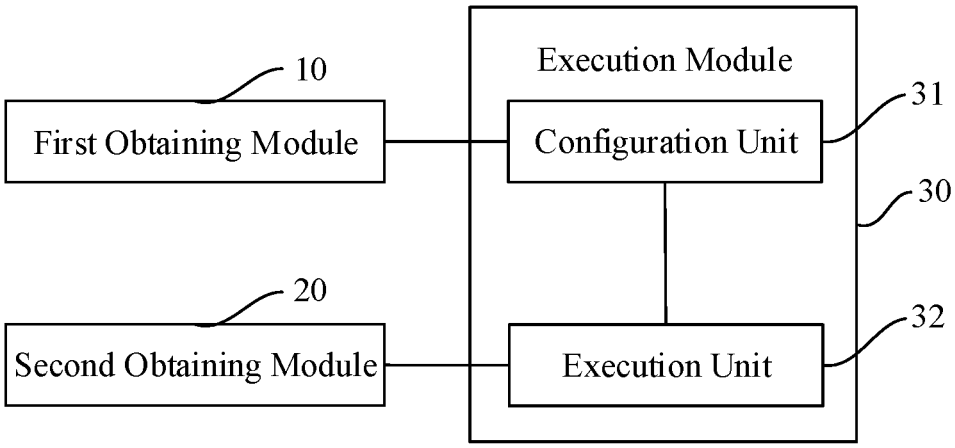
FIG. 6 is a structural block diagram illustrating a device for adjusting air volume of an air conditioner according to an exemplary embodiment.

As shown in FIG. 6, in some optional embodiments, the execution module 30 includes:

a configuration unit 31 configured to obtain a corresponding relationship between actual air volume and the actual height of the cover plate according to the curved surface features and the cover plate specifications; and an execution unit 32 configured to adjust the actual height of the cover plate according to the specified air volume and the corresponding relationship.

In some optional embodiments, the configuration unit is further configured to search in a database according to the curved surface features and the cover plate specifications to obtain the associated corresponding relationship.

In some optional embodiments, the configuration unit is further configured to:

obtain an actual opening of the air outlet according to the actual air volume;

obtain a first actual horizontal distance between an edge of the cover plate and the inner wall at the bottle mouth of the vase-shaped housing according to the actual opening of the air outlet and the curved surface features;

obtain the actual height of the cover plate according to the first actual horizontal distance and the curved surface features; and obtain the corresponding relationship between the actual air volume and the actual height of the cover plate.

In some optional embodiments, the configuration unit is further configured to obtain the actual height of the cover plate according to the following formula:

$$H=aL^2+(2ax_0+b)\cdot L$$

where H is the actual height of the cover plate, L is the first actual horizontal distance, a and b are constants representing the curved surface features, and $x_0$ is an abscissa of the edge of the cover plate during sealing after a rectangular coordinate system is established on a longitudinal section taken along a central axis of the bottle mouth.

In some optional embodiments, the configuration unit is further configured to:

obtain a second actual horizontal distance between an edge of the cover plate and the inner wall at the bottle mouth of the vase-shaped housing;

change the actual height of the cover plate;

obtain a first change height of the actual height of the cover plate;

obtain a first change distance of the second actual horizontal distance;

obtain a first ratio of the first change height to the first change distance;

obtain a relative unit change height of the cover plate corresponding to unit change air volume according to the first ratio, wherein an absolute value of the first ratio is positively correlated with the relative unit change height of the cover plate; and accumulate relative unit change heights of a plurality of cover plates to obtain the actual height of the cover plate.

In some optional embodiments, the configuration unit is further configured to obtain the relative unit change height of the cover plate corresponding to unit change air volume according to the first ratio specifically includes:

the configuration unit is further configured to multiply a correction coefficient based on the first ratio to obtain a correction ratio; and obtain the relative unit change height of the cover plate corresponding to the unit change air volume according to the correction ratio.

According to a fourth aspect of the present disclosure, there is provided a device for adjusting air volume of an air conditioner.

In some optional embodiments, the device is applied to an indoor unit of the air conditioner including an indoor unit with a vase-shaped housing, wherein the vase-shaped housing includes a bottle mouth, an air outlet of the indoor unit is provided at the bottle mouth of the vase-shaped housing, and a liftable cover plate is provided at the air outlet of the indoor unit, the device includes:

a processor; and a memory for storing instructions executable by the processor;

wherein the processor is configured to:

obtain specified air volume;

obtain curved surface features of an inner wall at the bottle mouth of the vase-shaped housing and cover plate specifications of the cover plate; and adjust an actual height of the cover plate according to the specified air volume, the curved surface features and the cover plate specifications.

In some exemplary embodiments, there is provided a non-transitory computer readable storage medium including instructions, for example, a memory including instructions, wherein the instructions can be executed by a processor to perform the aforementioned method. The non-transitory computer readable storage medium described above may be ROM (Read Only Memory), RAM (Random Access Memory), magnetic tape, optical storage device, and the like.

Those skilled in the art may recognize that the elements and algorithm steps of the examples described in the embodiments disclosed herein may be implemented by electronic hardware, or a combination of computer software and electronic hardware. Whether these functions are implemented by hardware or software depends on the specific application and design constraints of the technical solutions. Those skilled may use different methods to implement the described functions for each specific application, but such implementation should not be considered beyond the scope of the embodiments of the present disclosure. Those skilled may clearly understand that for convenience and conciseness of description, the specific work processes of the above-mentioned systems, devices and units may refer to corresponding processes in the above-mentioned method embodiments and will not be repeated herein.

In the embodiments disclosed herein, the disclosed methods and products (including but not limited to devices, equipment, etc.) may be implemented in other ways. For example, the device embodiments described above are only schematic. For example, the division of the units may be only a logical function division, and there may be other division manners in actual implementation. For example, a plurality of units or components may be combined or integrated into another system, or some features may be ignored or not implemented. In addition, the mutual coupling, direct coupling or communication connection shown or discussed may be indirect coupling or communication connection through some interfaces, devices or units, and may be in electrical, mechanical or other forms. The units described as separate components may or may not be physically separated, and the components displayed as units may or may not be physical units, i.e., may be located in one place or may be distributed to a plurality of network units. Some or all of the units may be selected to implement the embodiments according to actual needs. In addition, each functional unit in the embodiments of the present disclosure may be integrated in one processing unit, or each unit may exist separately physically, or two or more units may be integrated in one unit.

It should be understood that, the flowcharts and block diagrams in the drawings show the architecture, functions and operations of possible implementations of systems, methods and computer program products according to the embodiments of the present disclosure. In this regard, each block in the flowcharts or block diagrams may represent a module, program segment, or portion of code that includes one or more executable instructions for implementing specified logical functions. In some alternative implementations, the functions noted in the blocks may also occur in an order different from that noted in the drawings. For example, two consecutive blocks may actually be executed substantially in parallel, and they may sometimes be executed in a reverse order, depending on the function involved. In the description corresponding to the flowcharts and block diagrams in the drawings, operations or steps corresponding to different blocks may also occur in orders different from that disclosed in the description, and sometimes there is no specific order between different operations or steps. For example, two consecutive operations or steps may actually be executed substantially in parallel, and they may sometimes be executed in a reverse order, depending on the function involved Each block in the block diagrams and/or flowcharts, and combinations of blocks in the block diagrams and/or flowcharts, may be implemented by special hardware-based systems that perform specified functions or actions, or may be implemented by combinations of special hardware and computer instructions. The present disclosure is not limited to the structures already described above and shown in the accompanying drawings, and various modifications and changes may be made without departing from the scope. The scope of the present disclosure is limited only by the appended claims.

What is claimed is:

1. A method for adjusting air volume of an air conditioner, comprising an indoor unit with a vase-shaped housing, wherein the vase-shaped housing comprises a bottle mouth, an air outlet of the indoor unit is provided at the bottle mouth of the vase-shaped housing, and a liftable cover plate is provided at the air outlet of the indoor unit, the method comprising:

obtaining specified air volume;

obtaining curved surface features of an inner wall at the bottle mouth of the vase-shaped housing and cover plate specifications of the cover plate; and adjusting an actual height of the cover plate according to the specified air volume, the curved surface features and the cover plate specifications;

wherein the adjusting the actual height of the cover plate according to the specified air volume, the curved surface features and the cover plate specifications comprises:

obtaining a corresponding relationship between actual air volume and the actual height of the cover plate according to the curved surface features and the cover plate specifications; and adjusting the actual height of the cover plate according to the specified air volume and the corresponding relationship;

wherein the obtaining the corresponding relationship between the actual air volume and the actual height of the cover plate according to the curved sureface features and the cover plate specifications comprises:

obtaining a second actual horizontal distance between an edge of the cover plate and the inner wall at the bottle mouth of the vase-shaped housing;

changing the actual height of the cover plate;

obtaining a first change height of the cover plate;

obtaining a first change distance of the second actual horizontal distance;

obtaining a first ratio of the first change height to the first change distance;

obtaining a relative unit change height of the cover plate corresponding to unit change air volume according to the first ratio, wherein an absolute value of the first ratio is positively correlated with the relative unit change height of the cover plate; and accumulating relative unit change heights of a plurality of cover plates to obtain the actual height of the cover plate.

2. A device for adjusting air volume of an air conditioner comprising an indoor unit with a vase-shaped housing, wherein the vase-shaped housing comprises a bottle mouth, an air outlet of the indoor unit provided at the bottle mouth of the vase-shaped housing, and a liftable cover plate provided at the air outlet of the indoor unit, the device comprising:

a processor ; and a memory for storing instructions executable by the processor;

wherein the processor is configured to:

obtain specified air volume;

obtain curved surface features of an inner wall at the bottle mouth of the vase-shaped housing and cover plate specifications of the cover plate; and adjust an actual height of the cover plate according to the specified air volume, the curved surface features, and the cover plate specifications;

wherein the processor is configured to ajust the actual height of the cover plate according to the specified air volume, the curved surface features and the cover plate specifications by:

obtaining a corresponding relationship between actual air volume and the actual height of the cover plate according to the curved surface features and the cover plate specifications; and adjusting the actual height of the cover plate according to the specified air volume and the corresponding relationship;

wherein the obtaining the corresponding relationship between the actual air volume and the actual height of the cover plate according to the curved sureface features and the cover plate specifications comprises:

obtaining a second actual horizontal distance between an edge of the cover plate and the inner wall at the bottle mouth of the vase-shaped housing;

changing the actual height of the cover plate;

obtaining a first change height of the cover plate;

obtaining a first change distance of the second actual horizontal distance;

obtaining a first ratio of the first change height to the first change distance;

obtaining a relative unit change height of the cover plate corresponding to unit change air volume according to the first ratio, wherein an absolute value of the first ratio is positively correlated with the relative unit change height of the cover plate; and accumulating relative unit change heights of a plurality of cover plates to obtain the actual height of the cover plate.

3. A computer readable storage medium having a computer program stored thereon, when the computer program is executed by a processor in a device for adjusting air volume of an air conditioner, the device comprising an indoor unit with a vase-shaped housing, wherein the vase-shaped housing comprises a bottle mouth, an air outlet of the indoor unit is provided at the bottle mouth of the vase-shaped housing, and a liftable cover plate is provided at the air outlet of the indoor unit, the computer program causes the processor to:

obtain specified air volume;

obtain curved surface features of an inner wall at the bottle mouth of the vase-shaped housing and cover plate specifications of the cover plate; and adjust an actual height of the cover plate according to the specified air volume, the curved surface features and the cover plate specifications;

wherein the processor is configured to ajust the actual height of the cover plate according to the specified air volume, the curved surface features and the cover plate specifications by:

obtaining a corresponding relationship between actual air volume and the actual height of the cover plate according to the curved surface features and the cover plate specifications; and adjusting the actual height of the cover plate according to the specified air volume and the corresponding relationship;

wherein the obtaining the corresponding relationship between the actual air volume and the actual height of the cover plate according to the curved sureface features and the cover plate specifications comprises:

obtaining a second actual horizontal distance between an edge of the cover plate and the inner wall at the bottle mouth of the vase-shaped housing;

changing the actual height of the cover plate;

obtaining a first change height of the cover plate;

obtaining a first change distance of the second actual horizontal distance;

obtaining a first ratio of the first change height to the first change distance;

obtaining a relative unit change height of the cover plate corresponding to unit change air volume according to the first ratio, wherein an absolute value of the first ratio is positively correlated with the relative unit change height of the cover plate; and accumulating relative unit change heights of a plurality of cover plates to obtain the actual height of the cover plate.

* * * * *